US005707214A

United States Patent [19]

Schmidt

[11] Patent Number: 5,707,214

[45] Date of Patent: Jan. 13, 1998

[54] NOZZLE-VENTURI GAS LIFT FLOW CONTROL DEVICE AND METHOD FOR IMPROVING PRODUCTION RATE, LIFT EFFICIENCY, AND STABILITY OF GAS LIFT WELLS

[75] Inventor: Zelimir Schmidt, Tulsa, Okla.

[73] Assignee: Fluid Flow Engineering Company, Tulsa, Okla.

[21] Appl. No.: 723,169

[22] Filed: Sep. 27, 1996

Related U.S. Application Data

[63] Continuation of Ser. No. 434,037, May 2, 1995, abandoned, which is a continuation-in-part of Ser. No. 30,661, Sep. 7, 1994, abandoned, which is a continuation-in-part of Ser. No. 269,888, Jul. 1, 1994, abandoned.

[51] Int. Cl.[6] ..... F04F 1/08; E21B 21/00

[52] U.S. Cl. ..... 417/109; 417/108; 417/198; 166/320; 166/372

[58] Field of Search ..... 417/54, 108, 109, 417/110, 111, 116, 117, 115, 178, 198; 137/155; 166/320, 372, 374

[56] References Cited

U.S. PATENT DOCUMENTS

| | | | |
|---|---|---|---|
| 233,499 | 10/1880 | Frizell | 417/108 |
| 814,601 | 3/1906 | Harris | 417/109 |
| 1,602,190 | 10/1926 | Eddy et al. | 166/372 |
| 1,856,872 | 5/1932 | Kogan | 417/109 |
| 2,008,172 | 7/1935 | Bryant | 417/115 |
| 2,323,893 | 7/1943 | Boynton | 137/155 |
| 2,716,509 | 8/1955 | Saul | 417/108 |
| 2,717,648 | 9/1955 | Baker | 166/320 |
| 3,324,803 | 6/1967 | Kelley et al. | 137/155 |
| 3,523,744 | 8/1970 | Holladay, Jr. | 417/115 |
| 3,672,790 | 6/1972 | White et al. | 417/108 |
| 3,784,325 | 1/1974 | Coanda et al. | 417/170 |
| 3,884,299 | 5/1975 | McCarter et al. | 417/109 |
| 4,087,207 | 5/1978 | Chappel et al. | 417/54 |
| 4,111,608 | 9/1978 | Elliott et al. | 417/112 |
| 4,251,191 | 2/1981 | Gass et al. | 417/111 |
| 4,397,612 | 8/1983 | Kalina | 417/109 |
| 4,441,861 | 4/1984 | Canalizo | 417/54 |
| 4,573,877 | 3/1986 | Baumberg | 417/198 |
| 4,603,735 | 8/1986 | Black | 166/372 |
| 4,792,284 | 12/1988 | Straub | 417/198 |
| 5,066,198 | 11/1991 | Decker | 417/54 |
| 5,107,441 | 4/1992 | Decker | 137/155 |

OTHER PUBLICATIONS

Grupping, A. W.; Luca, C. W.F.; Vermeulen, F.D., "Heading Action Analyzed for Stabilization", *Oil & Gas Journal*, Jul. 23, 1984, pp. 47–51.

Grupping, A. W.; Luca, C.W.F.; Vermeulen, F.D., "These Methods Can Eliminate or Control Annulus heading", *Oil & Gas Journal*, Jul. 30, 1984, pp. 186–191.

Torre, A.J.; Schmidt, Z.; Blais, R.N.; Doty, D.R.; Brill, J.P., "Casing Heading in Flowing Oil Wells", *SPE Production Engineering*, Nov. 1987, pp. 297–303.

Asheim, H., "Criteria for Gas–Lift Stability", *Journal of Petroleum Technology*, Nov. 1988, pp. 1452–1456.

(List continued on next page.)

*Primary Examiner*—Timothy Thorpe
*Assistant Examiner*—Ted Kim
*Attorney, Agent, or Firm*—Martin Korn

[57] ABSTRACT

A gas flow control device for injecting gas into a production string for recovering pressure and reducing frictional losses, so that critical flow can be reached at lower pressure drops and higher production pressure, includes a nozzle having first and second ends, and a flow path therebetween, and a Venturi having first and second ends, and a flow path therebetween. The first end of the Venturi portion is disposed adjacent to the second end of the nozzle. The Venturi flow path coaxially aligned with the nozzle flow path to provide a continuous flow path through the valve. A method to increase the production rate, improve the lift efficiency, and eliminate or suppress instability in continuous-flow gas lift wells by use of a flow control device that has a gas flow rate performance that is independent of the tubing pressure even when the tubing pressure is as high as 80% to 93% of the casing pressure.

5 Claims, 9 Drawing Sheets

OTHER PUBLICATIONS

Alhanati, F.J.S.; Schmidt, Z.; Doty, D.R., "Continuous Gas-Lift Instability: Diagnosis, Criteria, and Solutions", Paper SPE 26554 presented at the 68th Annual Technical Conference and Exhibition of the Society of Petroleum Engineers, Houston, Texas Oct. 3-6, 1993, pp. 401-416.

Everitt, T. A., "Gas-Lift Optimization in a Large, Mature GOM Field", Paper SPE 28466 presented at the 69th Annual Tehnical Conference and Exhibition of the Society of Petroleum Engineers, New Orleans, LA, Sep. 25-28, 1994, pp. 25-33.

Clegg, J.D.; Gault, R.; Lea, J.; Winkler, H., "Specialists Share Experience With Artificial-Lift Methods", *Journal of Petroleum Technology,* May 1995, pp. 364-393.

"Gas Lift Valves", Teledyne Merla, May 1983, pp. 8-9.

"Fundamentals of Engineering Thermodynamics", Moran and Shapiro, 1988, pp. 414-415, Figure 9.30.

NOZZLE-VENTURI GAS LIFT FLOW CONTROL DEVICE AND METHOD FOR IMPROVING PRODUCTION RATE, LIFT EFFICIENCY, AND STABILITY OF GAS LIFT WELLS

RELATED APPLICATION

This application is a continuation of application Ser. No. 08/434,037, filed May 2, 1995, entitled "Nozzle-Venturi Gas Lift Flow Control Device and Method for Improving Production Rate, Life Efficiency, and Stability of Gas Lift Wells, now abandoned on Aug. 25, 1997 which is a continuation-in-part of application Ser. No. 08/301,661, filed Sep. 7, 1994, entitled "Nozzle-Venturi Gas Lift Flow Control Device", abandoned, which is a continuation-in-part application of Ser. No. 08/269,888 entitled "Venturi Orifice Gas Lift Valve", filed Jul. 1, 1994, abandoned.

BACKGROUND OF THE INVENTION

1. Field of the Invention

The present invention relates to gas flow control valves for injecting gas into the production string of a subterranean well utilizing gas lift equipment and techniques to enhance the flow of liquids from a geological formation, and more particularly to a gas lift flow-control device that achieves critical flow at low differential pressures and which implements a method of increasing and stabilizing the production rate in a continuous-flow gas lift well and a method of controlling the lift gas injection rate into a well with a pressure control device on the surface.

2. Description of the Related Art

In producing liquids, including water, oil, and oil with entrained gas, from a geological formation, natural pressure in the reservoir acts to lift the liquids in a wellbore upwards to the surface. The reservoir pressure must exceed the hydrostatic head of the fluid in the wellbore and any back-pressure imposed by the production facilities at the surface for the well to produce naturally. The reservoir pressure can decline over time, requiring artificial steps to improve lift. One commonly known method of augmenting lift is to inject gas into the production string, or tubing, to decrease the density of the fluid, thereby decreasing the hydrostatic head to allow the reservoir pressure to act more favorably on the fluids to be lifted to the surface. This gas injection is usually accomplished by forcing gas down the annulus between the production tubing, which conducts reservoir fluids to the surface, and the casing of the well. Then the gas is constrained to flow through a gas flow control device at a predetermined depth into the production tubing. The gas bubbles mix with the reservoir fluids, thus reducing the overall density of the mixture and improving lift.

Alternatively, gas and/or relatively less dense fluids from another formation penetrated by the wellbore can be constrained to flow into the production tubing to decrease the overall density of the fluids to be produced from the well. This procedure, commonly referred to as autolifting, uses formation fluids (gas or light hydrocarbon liquids) from another formation having a formation pressure greater than the formation from which the liquids to be lifted are produced. Thus, instead of compressing gas at the surface and injecting the gas down the casing of the well to the flow control device, another formation having sufficiently higher pressure is isolated to where the gas and/or less dense fluid from the isolated formation is constrained to flow down the annulus between the casing and the production tubing, through the flow control device, and into the production tubing, thereby reducing the overall density of the mixture in the production tubing and providing lift.

There are two types of gas flow control devices commonly employed to control the injected gas into the production tubing, namely gas lift valves and orifice valves. Gas lift valves are normally closed in a biased position whereby a movable stem is forced upon a matching seat to close the gas lift valve and prevent the flow of injected gas therethrough. On the other hand, orifice valves have no moving parts other than a check valve to prevent reverse flow therethrough. Therefore, orifice valves are simply open to flow of injection gas, but are closed to flow in the opposite direction.

Gas lift valves are used as unloading valves at different locations throughout the well, and may also be used to control the injection of the gas at the most optimum point of injection. Orifice valves are used to control injection gas rates into the production tubing at the optimum point of injection. In certain situations, gas lift valves are sometimes considered less desirable because of their expense and because their construction, namely the stem and seat arrangement, obstructs gas flow. An orifice valve overcomes both of these objections, and, therefore, is often employed at the optimum point of injection. The valve that is installed at the optimum point of injection is commonly called the operating valve.

Flow instability is a common problem existing in wells which employ continuous-flow gas lift. Flow instability results in (1) large fluctuations in the production flow rate, (2) large fluctuations in the gas injection rate, and (3) large fluctuations in the pressure of both the tubing and casing. Understanding the influence that the gas flow control device has on flow instability is crucial to understanding the present invention.

Flow instability in a continuous-flow gas lift well can be characterized as a cyclic process. As the gas injection rate through the gas flow control device begins to increase, the density of the fluid in the production tubing string decreases, which, in turn, results in more reservoir fluid entering the wellbore. This portion of the cycle continues and accelerates until the pressure in the annulus drops, i.e., the supply of injection gas in the annulus diminishes. The pressure drop in the annulus results in a decrease in the pressure differential across the gas flow control device and, thus, a decrease in the rate of gas injection through the gas flow control device and into the production tubing. As a result of the decrease in the gas injection rate through the gas flow control device, the density of the fluid in the tubing string increases, causing the production pressure, or downstream pressure, to increase, which, in turn, results in less reservoir fluid entering the wellbore. This part of the cycle continues until the pressure in the annulus increases sufficiently to where the rate of gas injection through the gas flow control device once again increases.

The differential pressure across the gas flow control device is defined as the difference between the injection pressure and the production pressure. The differential pressure can also be listed as a percentage of the injection pressure. In this context, the injection pressure is also referred to as either the upstream or casing pressure, and the production pressure is also referred to as either the tubing or downstream pressure.

Flow instability in continuous-flow gas lift wells occurs where the gas flow control device allows the gas injection rate through the device to fluctuate as a function of the production, or downstream, pressure. The gas injection rate through a prior art square-edged orifice gas flow control device fluctuates as a the production, or downstream, pressure fluctuates.

Choking at the flowline downstream from the production tubing string is the accepted industry practice that is used to lessen the effect of the above mentioned factors which cause flow instability. Choking typically increases the average flowing bottom hole pressure in the tubing to be higher than desired. This, in turn, reduces the rate of fluid that is produced from the reservoir. To compensate for flowline choking, more gas injection is required. This increase in gas injection adversely affects the efficiency of the gas lift operation because of the increase in lifting costs and the inefficient use of injection gas.

Fluctuations in the bottom hole tubing pressure cause fluctuations in the rates of gas flowing through the flow control device; i.e., with large bottom hole tubing pressure decreases, the gas injection rate through the flow control device increases. This phenomena is largely uncontrollable and unpredictable using existing gas flow control devices.

The aforementioned fluctuations in tubing pressure may also result in problems at the surface. For instance, segregated flows of oil and gas mixtures can be forced up the production tubing to the surface, resulting in severe pressure surges throughout the tubing and within the surface equipment. This phenomena is commonly referred to as slugging. When the segregated fluids from the well reach the production facility and enter the first stage separator, the particular instantaneous flow rate, or surge, of liquids may exceed the flow capacity of the separator, causing liquid carryover into the gas lines. This can lead to repeated costly shut downs and loss of revenue from all wells leading into that particular facility.

The average bottom-hole flowing pressure in the tubing during unstable flow is significantly higher than during stable flow. During slugging, the bottom-hole flowing pressure in the tubing increases due to the higher density fluid present in the tubing string. The pressure increase is further aggravated by the prior art flow control device because it passes less gas as the bottom-hole flowing pressure in the tubing increases, thereby providing less gas into the tubing.

Accordingly, there is a need to provide a gas flow control device which increases the production rate of, and stabilizes the flow of production from, a continuous-flow gas lift well.

There is a further need to achieve improved performance with both an improved orifice valve and an improved gas lift valve that are used as gas flow control devices.

There is a further need to provide a gas flow control device having a consistent and predictable gas injection rate.

There is also a need to provide a gas flow control device which has a reduced sensitivity to fluctuations in tubing pressure.

There is still a further need to provide a gas flow control device whereby the lift gas injection rate can be controlled from the surface.

The present invention overcomes the deficiencies of the prior art.

SUMMARY OF THE INVENTION

To address the above-described problems with, and deficiencies of, the prior art, it is a primary object of the present invention to provide a gas flow control device through which a predictable and constant gas injection rate can be established, and which overcomes the flow instability that commonly occurs in gas lift wells.

It is a further object of the present invention to provide an improved gas flow control device whereby the gas injection rates through the gas flow control device are controllable at the surface.

It is a further object of the present invention to provide a method of increasing the production rate of a continuous-flow gas lift well.

It is a further object of the present invention to provide a method of stabilizing the production from a continuous-flow gas lift well.

It is still a further object of the present invention to provide an improved gas flow control device for injecting gas into a production string whereby the injection gas pressure within the flow control device is recovered and frictional losses through the gas flow control device are reduced, thereby establishing critical flow at a lower differential pressure across the gas flow control device.

It is still a further object of the present invention to provide a method of eliminating the effect of tubing pressure on the gas injection rate through a gas flow control device utilized in a continuous-flow gas lift well.

In an established continuous-flow gas lift system, there are five major independent variables which affect the instability of a well and its rate of production, namely, the tubing pressure at the gas flow control device, the casing pressure at the gas flow control device, the gas injection rate through the gas flow control device, the orifice geometry within the gas flow control device, and the propensity for, or the ability of, the formation to produce liquids. It is a primary object of the invention to provide a gas flow control device which reduces the instability in the continuous-flow gas lift well by minimizing the effect of one major variable, the tubing pressure at the gas flow control device. Minimizing the effect of tubing pressure is achieved by means of controlling three of the remaining major variables, namely the casing pressure, the gas injection rate, and the geometry within the gas flow control device.

Accordingly, the gas flow control device of the present invention controls the rate at which gas is injected into a production string and includes a housing with at least one inlet port, at least one outlet port and a nozzle-Venturi orifice. The nozzle-Venturi orifice, which may also be referred to as a circular-arc-Venturi, is a converging-diverging pathway that is made of two parts: a nozzle portion and a Venturi tube, or Venturi portion. The nozzle portion includes first and second ends, and a flow path therebetween. The nozzle portion converges, or is progressively restrictive, from the nozzle first end to the nozzle second end. The Venturi portion includes a first and a second end, and a flow path therebetween. The first end of the Venturi tube, also referred to as a Venturi for simplicity, is disposed adjacent to the second end of the nozzle portion. The Venturi portion diverges, or is progressively larger, between the Venturi first end and the Venturi second end. The Venturi flow path is aligned with the nozzle flow path to provide a continuous flow path through the device. Pressurized gas from the annulus between the casing and production tubing is constrained to flow through the at least one inlet port, through the continuous flow path, through the at least one outlet port, and into the production tubing.

In a preferred embodiment of the invention, the nozzle portion of the gas flow control device includes curvilinear sidewalls extending from the nozzle first end to the nozzle second end.

In a preferred embodiment of the invention, the diameter of the nozzle first end is greater than the diameter of the nozzle second end. Further, the diameter of the Venturi first end is equal to the diameter of the nozzle first end and less than the diameter of the Venturi second end.

In a preferred embodiment of the invention, the cross sectional area of the nozzle first end is greater than the cross sectional area of the nozzle second end. The cross sectional area of the Venturi first end is equal to the cross sectional area of the nozzle second end and less than the cross sectional area of the Venturi second end.

In a preferred embodiment of the invention, the ratio of the cross sectional area of the nozzle second end to the cross sectional area of the nozzle first end is approximately 0.4.

In a preferred embodiment of the invention, the ratio of the cross sectional area of the nozzle second end to the cross sectional area of the nozzle first end is less than 0.4.

In a preferred embodiment of the invention, the gas flowing through the gas flow control device achieves critical flow at a differential pressure of less than 46% of the gas injection pressure. Here, the differential pressure is the difference between the gas injection pressure and the production pressure.

In a preferred embodiment of the invention, gas flowing through the gas flow control device achieves critical flow at a differential pressure of between approximately 4% and 10% of the gas injection pressure.

In a preferred embodiment of the invention, the gas flowing through the gas flow control device achieves critical flow at a differential pressure of between approximately 5% and 46% of the gas injection pressure.

In a preferred embodiment of the present invention, gas flowing through the gas flow device achieves critical flow at a differential pressure of less than 10% of the gas injection pressure.

In a preferred embodiment of the invention, the nozzle portion includes curvilinear sidewalls extending from the nozzle first end to the nozzle second end. The sidewalls have a radius of curvature greater than the diameter of the nozzle second end.

In a preferred embodiment of the invention, the nozzle portion includes curvilinear sidewalls extending from the nozzle first end to the nozzle second end. The sidewalls have a radius of curvature equal to about 1.5 to about 2.5 times the diameter of the nozzle second end.

In a preferred embodiment of the invention, the nozzle portion includes curvilinear sidewalls extending from the nozzle first end to the nozzle second end, and the sidewalls have a radius of curvature equal to about 1.9 times the diameter of the nozzle second end.

In a preferred embodiment of the invention, the Venturi portion includes Venturi walls that extend from the Venturi first end to the Venturi second end. The Venturi walls form an angle of about 4 degrees to about 15 degrees with respect to the longitudinal axis of the Venturi flow path.

In a preferred embodiment of the invention, the Venturi portion includes Venturi walls extending from the Venturi first end to the Venturi second end. The Venturi walls form an angle of about 6 degrees with respect to the longitudinal axis of the Venturi flow path.

In a preferred embodiment of the invention, the Venturi portion includes Venturi sidewalls that are circular in cross section and extend from the Venturi first end to the Venturi second.

In accordance with the present invention, a method of controlling the rate of gas injected into a production tubing string is provided. The tubing string is positioned within a well and concentric to casing, forming an annulus therebetween. A gas flow control device is placed within the well at a predetermined location, the gas flow control device comprising a housing including at least one inlet port and at least one outlet port, and an orifice comprising a nozzle portion and a Venturi portion, the nozzle portion including a nozzle first end, a nozzle second end, and a nozzle flow path between the nozzle first end and the nozzle second end, the nozzle flowpath converging from the first nozzle end to the second nozzle end, and the Venturi portion including a first end and a second end, and a Venturi flow path therebetween, the Venturi flow path diverging from the Venturi first end to the Venturi second end, the Venturi first end being disposed adjacent the nozzle second end, the Venturi flow path being aligned with the nozzle flow path to provide a continuous flow path, the gas flow control device positioned for transmitting the flow of injected gas from the annulus into the production tubing string. Compressed gas is forced into the annulus. The compressed gas is constrained to flow through the gas flow control device to mix the gas with reservoir fluids within the production tubing string, thereby reducing the density of the reservoir fluids. The pressure of the gas forced into the annulus is controlled with a pressure control device, thereby increasing the gas injection rate through the gas flow control device by increasing the pressure of the gas in the annulus, and decreasing the gas injection rate through the gas flow control device by decreasing the pressure of the gas in the annulus.

In accordance with the present invention, a method is provided for eliminating instability in a production tubing string of a continuous-flow gas lift well. The production tubing string is positioned within said well and concentric to casing, said casing and said concentric production tubing string forming an annulus therebetween. A gas flow control device is positioned within said well at a predetermined location, said gas flow control device comprising a housing including at least one inlet port and at least one outlet port; and an orifice comprising a nozzle portion and a Venturi portion; said nozzle portion including a nozzle first end, a nozzle second end, and a nozzle flow path between said nozzle first end and said nozzle second end, said nozzle flowpath converging from said first nozzle end to said second nozzle end; and said Venturi portion including a first end and a second end, and a Venturi flow path therebetween, said Venturi flow path diverging from said Venturi first end to said Venturi second end, said Venturi first end being disposed adjacent said nozzle second end, said Venturi flow path being aligned with said nozzle flow path to provide a continuous flow path; said gas flow control device positioned for transmitting the flow of injected gas from the annulus into the production tubing string. Compressed gas is forced into the annulus. The compressed gas is constrained to flow through said gas flow control device to mix said gas with reservoir fluids within the production tubing string, thereby reducing the density of said reservoir fluids. The pressure of the gas forced into the annulus is controlled with a pressure control device to achieve critical flow through the gas flow control device, thereby maintaining a constant gas injection rate across said gas flow control device that is independent of the pressure within the production tubing string.

In accordance with the present invention, a method of eliminating instability in continuous-flow gas lift wells is provided by stabilizing the gas injection rate through the gas flow control device so that the gas injection rate is independent of the typical tubing pressure fluctuations that occur in a continuous-flow gas lift well.

It is contemplated that fluids, namely both gas and liquids, can be used for the lifting of formation fluids to the surface. Accordingly, while the present invention refers to "gas lift" and "gas flow control devices," it is contemplated that fluids, having relatively lower density than the formation fluids to be lifted, can be injected through the flow control device into the production tubing to decrease the density of the mixture to improve lift.

The foregoing has outlined the features and technical advantages of the present invention so that those skilled in the art may better understand the detailed description of the invention that follows. Features and advantages of the invention that are described above and hereinafter form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, and for further advantages thereof, reference is now made to the following Description of the Preferred Embodiments taken in conjunction with the accompanying Drawing in which.

DESCRIPTION OF THE PREFERRED EMBODIMENTS

Figure 1:
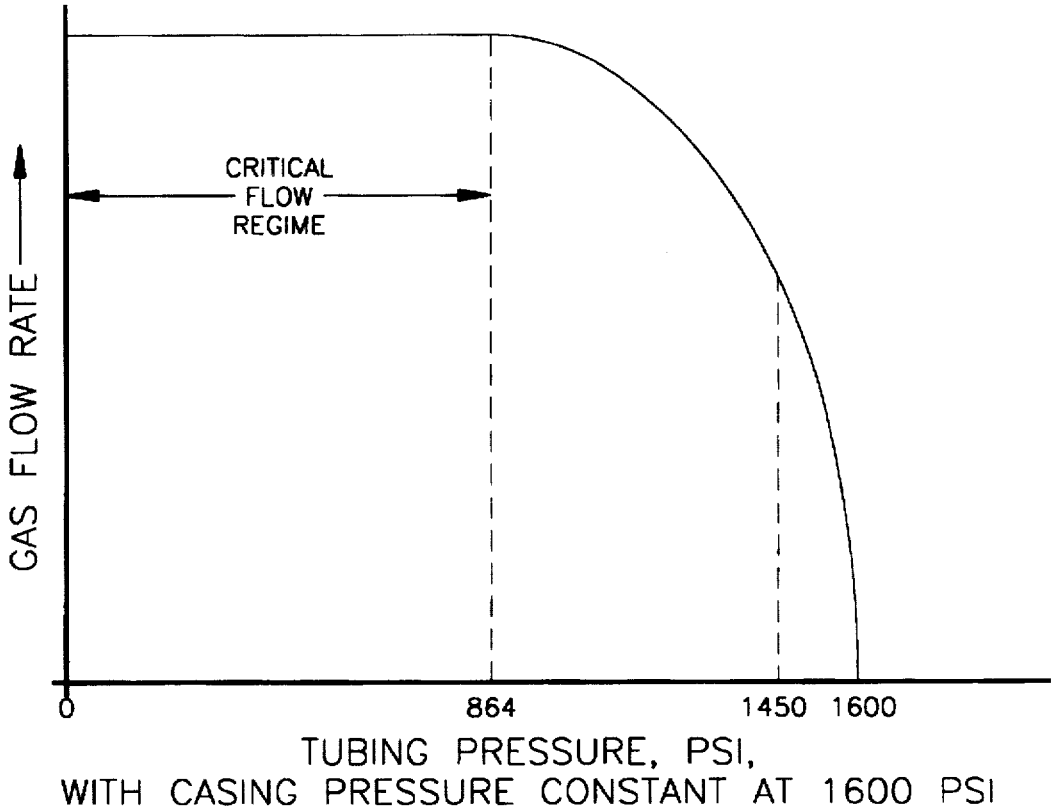
FIG. 1 PRIOR ART
FIG. 1 shows a graph which illustrates orifice gas injection rate performance in a typical, prior art high pressure gas lift system.

In order to illustrate the influence of the prior art orifice used in a gas flow control device, consider an example where the casing pressure of the wellbore, at the depth of gas injection through the gas flow control device, is a constant 1600 psig, and the desired tubing pressure is 150 psi less at 1450 psig. In this illustration, the casing pressure is defined as the upstream pressure of the orifice and the tubing pressure is defined as the downstream pressure of the orifice. FIG. 1 shows the typical performance of a prior art, square-edged orifice at these conditions. As the tubing pressure increases, the gas injection rate through the orifice decreases. Conversely, as the tubing pressure decreases, the gas injection rate through the orifice increases.

Figure 2:
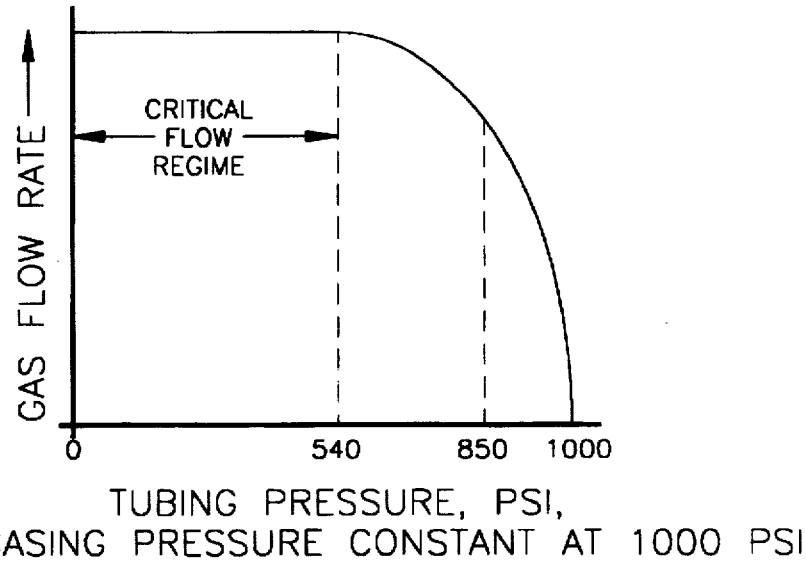
FIG. 2 PRIOR ART
FIG. 2 shows a graph which illustrates orifice gas injection rate performance in a typical, prior art low pressure gas lift system.

FIG. 2 also illustrates the effect of the prior art orifice used in a gas flow control device. In this illustration, the prior art orifice is provided in an environment at lower casing and tubing pressures of 1000 psig and 850 psig, respectively.

Typically the desired pressure drop across the prior art orifice is between 100 and 200 psi. However, at pressure drops of 150 to 200 psi, high injection pressures are required, resulting in high gas compression costs. Where the pressure drop is under 100 psi, the gas injection rate becomes more unpredictable. Thus, a pressure drop of under 100 psi is usually not considered due to the lack of accurate data and the potential of designing an inefficient gas lift system. Accordingly, a pressure drop in excess of 100 psi across the prior art orifice is typically desired and used as a safety factor in designing the gas lift system.

As evidenced by FIGS. 1 and 2, and as known in the art, the gas injection rate through the prior art orifice continues to increase until the tubing pressure declines to a value that is about 54% of the constant casing pressure. Thereafter, the gas injection rate through the orifice remains constant as the tubing pressure is lowered. The industry properly understands that critical flow through the prior art square-edged orifice is established when the tubing pressure is about 54% of the casing pressure. When the tubing pressure drops to the critical flow regime (i.e., the tubing pressure is 54% of the casing pressure), the gas injection rate through the orifice remains constant and independent of the tubing pressure.

Establishing the critical flow regime through the orifice acts to eliminate flow instability. For example, for the well operating at a tubing pressure of 1450 psig, establishing critical flow through the prior art, square-edged gas flow control device could be established by increasing the casing pressure from 1600 psig to 2700 psig or above. However, creating such a high pressure drop across the orifice is not economically feasible due to the additional cost in gas compression. Furthermore, this practice is not practical due to the increased likelihood of mechanical problems.

It is an object of the present invention to provide an orifice valve that seeks to reduce and effectively eliminate flow instability under normal conditions. Specifically, it is an object of the present invention to provide a flow control device which has the performance characteristics that are illustrated in FIG. 3, where the critical flow regime and a constant injection rate are reached when the tubing pressure is approximately 90%–95% or less of the casing pressure, as opposed to the industry standard of 54% for the prior art, square-edged orifice.

Figure 3:
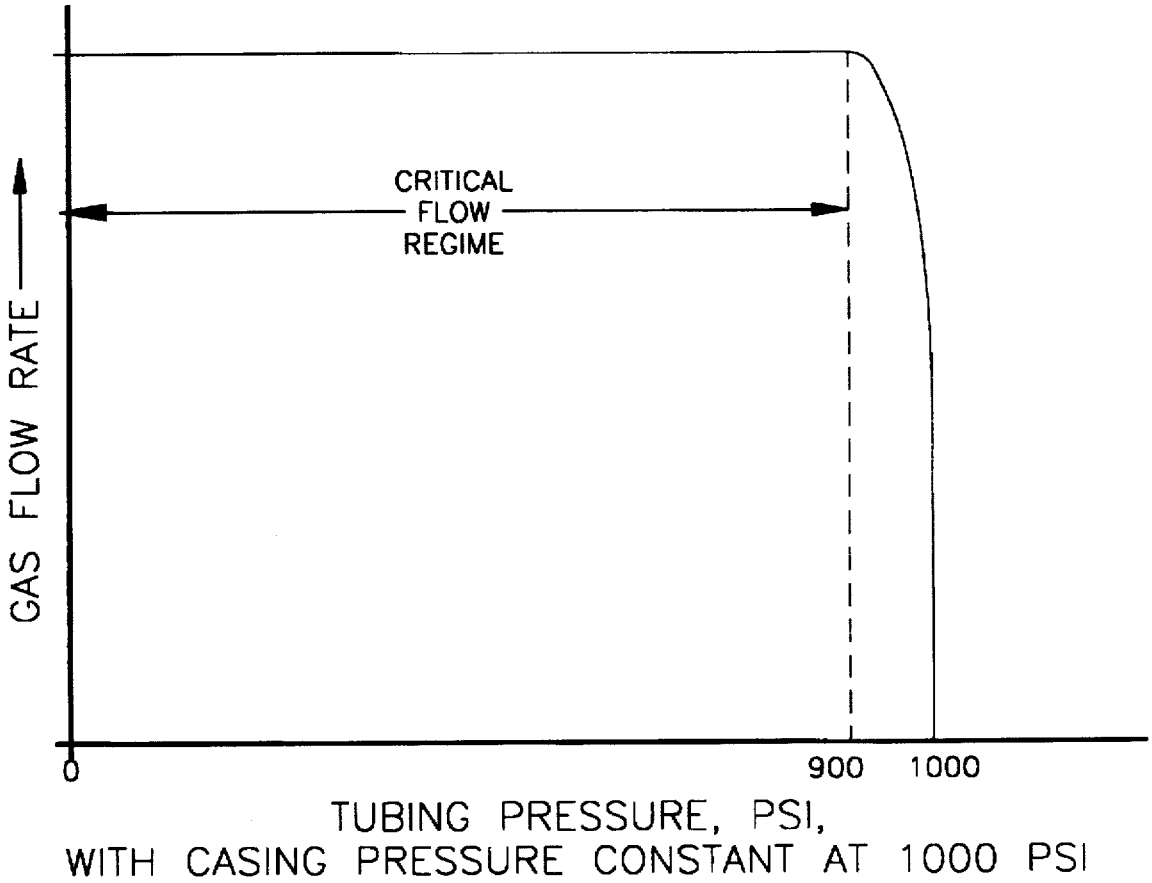
FIG. 3 shows a graph which illustrates the desired gas injection rate performance in a gas flow control device to eliminate instability in a continuous-flow gas lift well.

FIG. 3 is a graph which illustrates the desired flow rate performance in a gas control device of the present invention where the constant casing pressure is 1000 psig. Therefore, if the tubing pressure declines below approximately 900 psig the gas injection rate through the control device remains fixed. Thus, for a typical pressure drop of 100 to 200 psi across the gas flow control device, a constant gas injection rate can be achieved resulting in a stabilized well and improved economics.

Another advantage of the orifice valve of the present invention is the capability of controlling the injection gas rate through the gas flow control device, without causing instability, by simply controlling the surface injection pressure. Typically, this also has the effect of controlling the production rate of the liquids from the wellbore. Thus, by using the orifice valve of the present invention downhole, the operator can increase the pressure of the gas at the surface to increase the injection pressure (casing or upstream pressure) at the gas flow control device, which, in turn, increases the differential pressure across the gas flow control device and, therefore, the rate of gas injection through the gas flow control device. This, in turn, decreases the density of the fluid in the production tubing string, which allows more fluids from the reservoir to enter the wellbore and be produced. Increasing the pressure of the injected gas increases the density of the gas such that, for the same restriction in the gas flow control device, the gas injection rate is increased.

Figure 4:
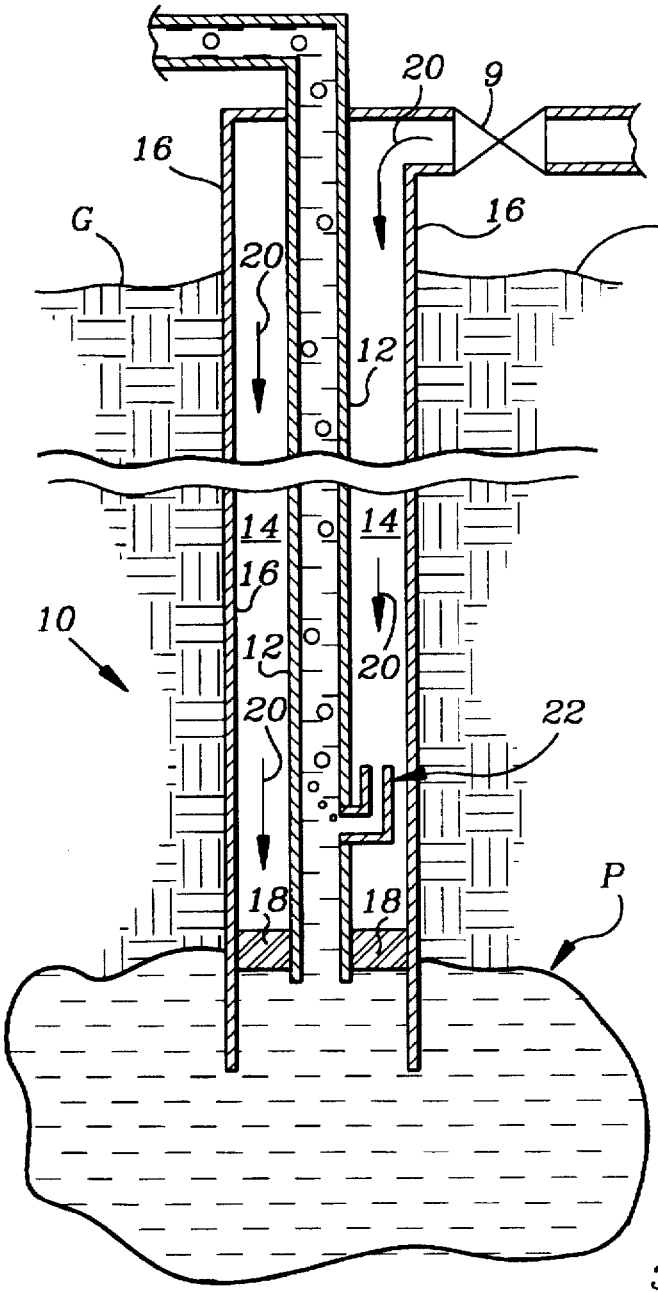
FIG. 4 illustrates a cross-sectional, side-elevational, diagrammatic view of the environment of a gas injection control device.

The present invention is employed in an exemplary environment that is shown in FIG. 4. A gas lift well system 10 extends from above ground G, where system 10 is connected to a pressurized gas source (not shown) and to petroleum recovery equipment (not shown), and a subterranean petroleum reservoir P. Petroleum rises in production tubing 12. Pressurized gas is introduced into annulus 14, which exists between the production tubing 12 and outer steel casing 16. Annulus 14 is sealed at the bottom of casing 16 by a packer 18. Pressurized gas is supplied from a source, such as a compressor (not shown). The gas pressure in the annulus 14 is regulated by a pressure control device 9, namely either an adjustable choke or a regulator, at the surface. The pressurized gas, represented by arrows 20, flows from the compressor, through the pressure control device 9, and through the annulus 14 into tubing 12 via a gas flow control device 22. Gas injected into production tubing 12 decreases the density of petroleum rising to the surface and enables natural reservoir pressure to maintain this flow. The pressure control device 9 is utilized at the surface to control the pressure in the annulus 14, which, in turn, establishes the injection pressure (also referred to as the casing pressure or upstream pressure) at the gas flow control device 22, the differential pressure across the gas flow control device, and, thus, the rate of injection through the gas flow control device 22.

While the pressure control device 9 is shown at the surface in FIG. 4, it is contemplated that a pressure control device can be installed within the annulus at a depth more proximate the gas flow control device 22. In this situation, a certain amount of annulus is isolated to form a chamber for injection gas whereby the gas to be injected is delivered to the chamber, and the gas pressure regulated by the pressure control device which, in turn, is controlled from the surface via a hydraulic or electric control line.

Furthermore, a single well bore will often times intersect a number of producing formations and, for economic reasons, these formations, referred to as production zones, are isolated by installing packoff devices so that the individual zones can be produced independently. A plurality of tubing strings are thus employed to produce the specific formations. The limitations of the prior art gas flow control device, namely its dynamic performance, exacerbates the flow instability in well completions with a plurality of production tubing strings. In such a well, instability is more likely to occur in each of the individual production tubing strings of the gas lift system because the common annulus supplies the injection gas to each gas flow control device and the injection rate through each prior art gas flow control device is completely unpredictable and independent. The present invention provides a constant gas injection rate into each tubing string and will, therefore, diminish the flow instability common in wells having a plurality of production strings.

Figure 5:
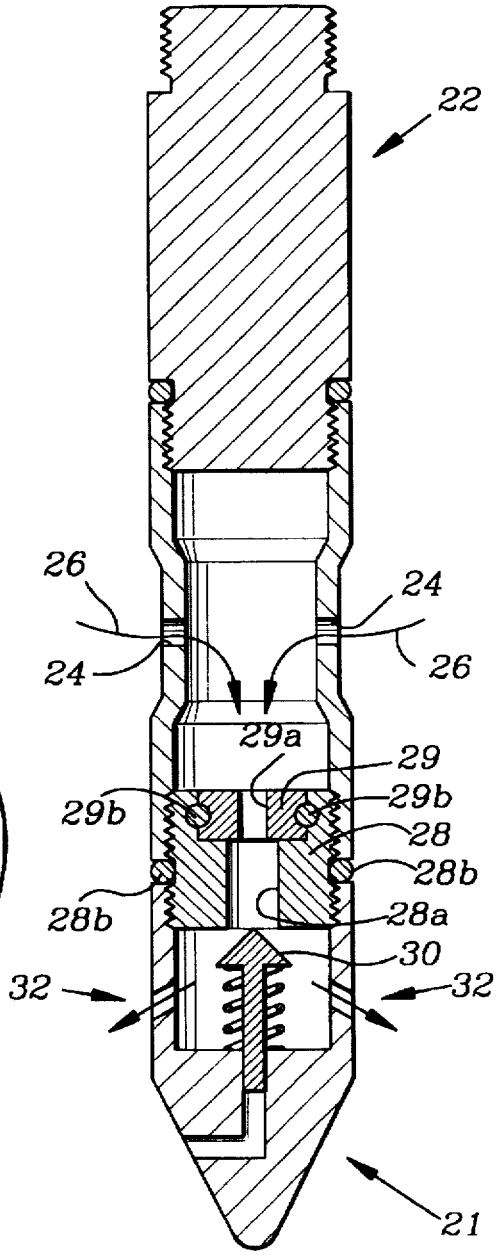
FIG. 5 PRIOR ART
FIG. 5 illustrates a cross-sectional view of a standard orifice gas injection control device having a square-edged orifice.

A prior art gas flow control device 22 having a square-edged orifice is illustrated in FIG. 5. The direction of the gas flow through the gas flow control device is indicated by arrows 26. Pressurized gas at injection pressure enters the prior art flow control device 22 through inlets 24 and flows through a square-edged orifice 29, containing passage **29*a* and seal 29*b*. Gas then passes through passageway 28*a* of an orifice holder 28 and past the check valve 30. Gas is then discharged through outlet 32 at the nose end 21, at production pressure, and passes into production tubing 12 (FIG. 4). The passage 29*a* and passageway 28*a*** typically have circular cross-sections, when considering those cross-sections are taken along planes perpendicular to the longitudinal axis of the gas flow control device.

Figure 6A:
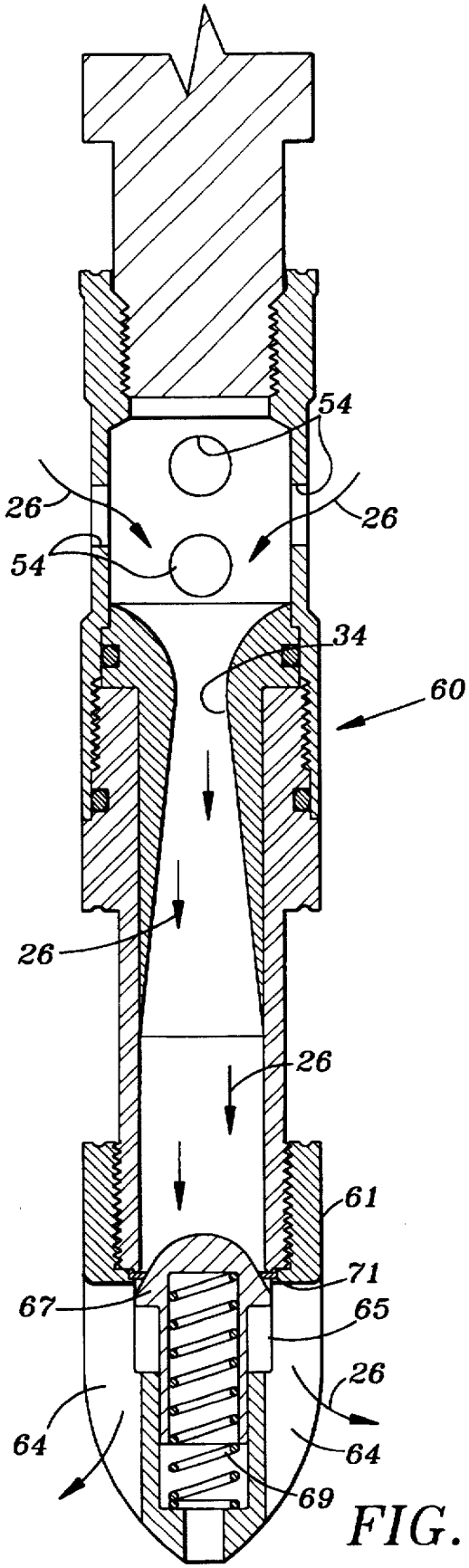
FIGS. 6A and 6B illustrate a cross-sectional view of an exemplary orifice gas flow control device of the present invention including a nozzle-Venturi orifice.
Figure 6B:
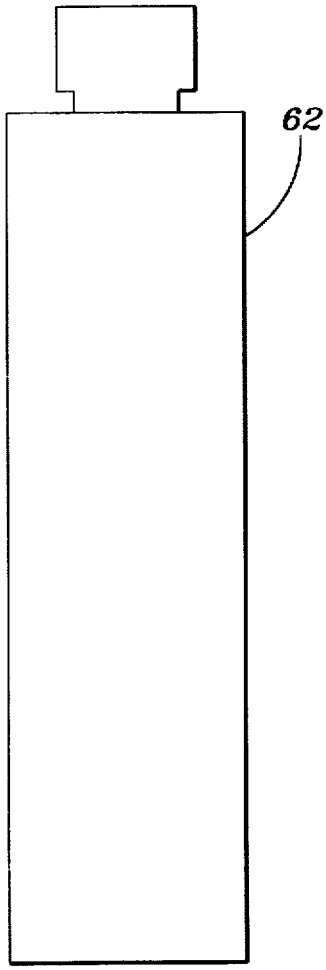

FIGS. 6A and 6B illustrates an exemplary gas flow control device 60 of the present invention. The gas flow control device 60 has generally the same dimensions and components as those of the prior art gas flow control device 22 (illustrated in FIG. 5), including a dummy tail section 62, inlet ports 54 and nose end 61 with a check valve 65 and outlet ports 64; the check valve 65 includes a dart 67, a spring 69, and a check seal 71. However, the gas flow control device 60 of the present invention includes a nozzle-Venturi orifice 34, instead of the square-edged orifice 29 found in the prior art.

The direction of the gas flow through the gas flow control device of the present invention is indicated by arrows 26. Pressurized gas at injection pressure (casing pressure) enters the inlet ports 54 and flows through the nozzle-Venturi orifice 34 and past the check valve 65. The gas is then discharged through the outlet ports 64, at production pressure (downstream pressure or tubing pressure), and passes into the production tubing.

Figure 6C:
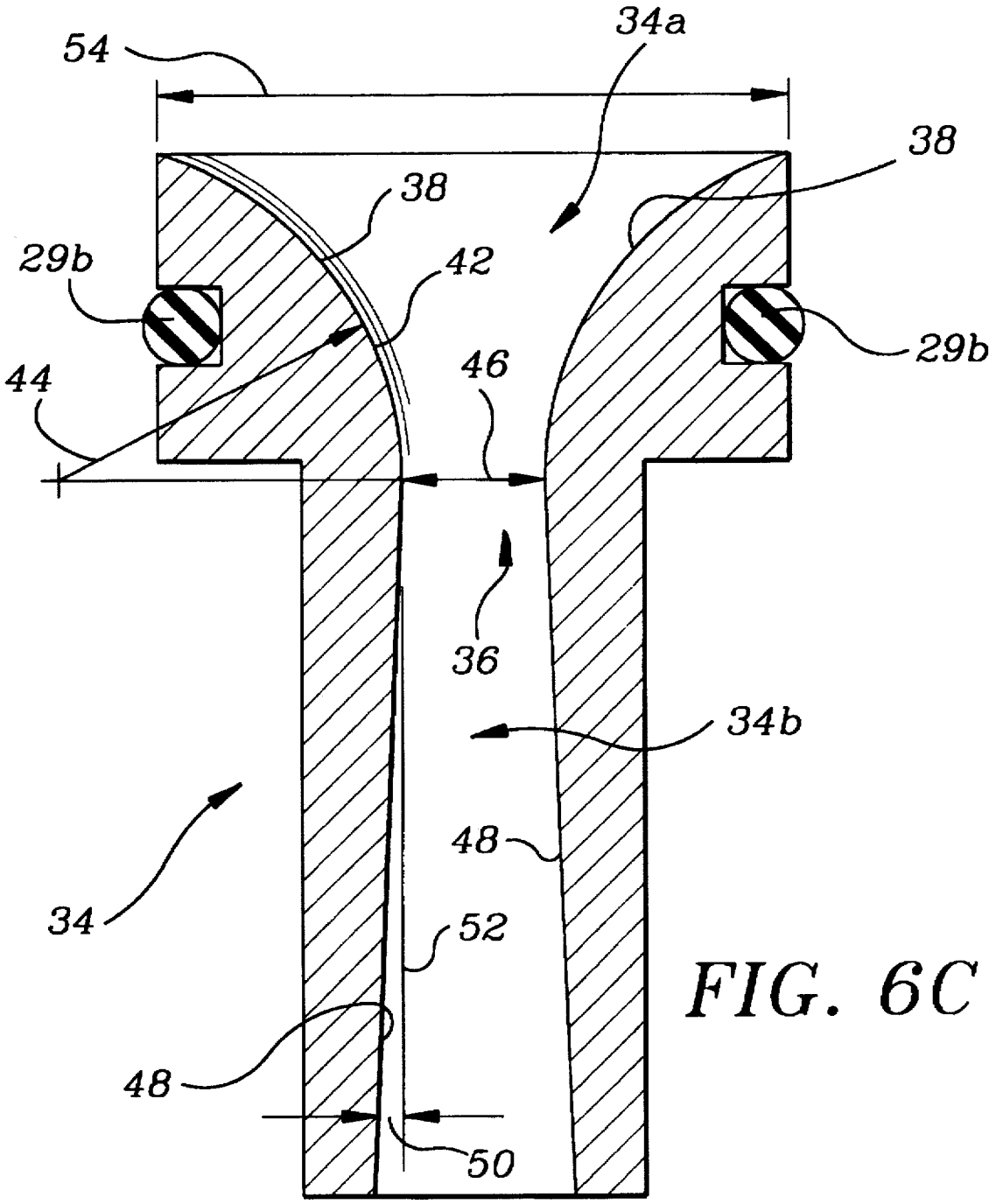
FIG. 6C illustrates a cross-sectional view of a nozzle-Venturi orifice assembly that is included within a gas flow control device of the present invention.

An exemplary nozzle-Venturi orifice 34 is illustrated in detail in FIG. 6C and may comprise, for example, a circular arc Venturi, and includes a nozzle portion **34*a* and a Venturi portion 34*b*. Nozzle portion 34*a* lies above a throat 36, and Venturi portion 34*b* lies below throat 36**.

Nozzle portion **34*a* includes sidewalls 38 which offer minimal resistance to the flow of fluid (gas or liquid) as the fluid approaches throat 36. Sidewalls 38 are progressively restrictive to throat 36. The cross-sectional area of throat 36 is less than the cross-sectional area of nozzle portion 34*a* and Venturi portion 34*b***.

Sidewalls 38 are curved, or curvilinear, such that the slopes of tangent lines measured at each point along the curve 42 of nozzle portion **34*a*, slope being considered in the mathematical sense, are greater at tangent points approaching throat 36. Also, the curvature of nozzle portion 34*a* is such that there is a radius of curvature 44 which is greater than a diameter 46 of the throat 36** by a factor between 1.5 and 2.5, a preferred value being 1.9.

Below throat 36, Venturi **34*b* increases in cross-sectional area at a rate such that vertical walls 48 thereof form an angle 50 to a vertical, or longitudinal, direction 52. Angle 50** lies within a range of four to fifteen degrees, a preferred value being six degrees.

The ratio of the cross-sectional area at the diameter 46 of throat 36 to the cross-sectional area at the widest point of nozzle portion **34*a*, as measured at the mouth 54**, is equal to or less than 0.4.

Cross-sections of nozzle-Venturi orifice 34, including cross-sections of the nozzle portion and the Venturi portion, considering those cross-sections taken along planes perpendicular to the Venturi axis, are generally represented as being circular. This is due to the expectation that manufacturing processes for forming nozzle-Venturi orifice 34, or for forming a die or mold to manufacture the same will be centered around cutting a rotating piece of stock, as exemplified by a lathe operation. However, it is contemplated that other manufacturing processes are possible, and that other geometries for the cross-sections of the nozzle portion and Venturi portion are thus possible. For example, corresponding cross-sections of nozzle-Venturi orifice 34 may be rectangular, elliptical, polygonal, hypergeometric elliptical, or even of other configurations.

Gas flowing within nozzle portion 34*a* of nozzle-Venturi orifice 34 flows at a high velocity and a low pressure. The gas flowing through Venturi portion 34*b* decreases in velocity and increases in pressure such that the gas exiting the valve 22 has pressure recovered with a minimal amount of energy or pressure loss.

For optimum performance, the nozzle portion 34*a* and the Venturi portion 34*b* of the nozzle-Venturi orifice 34 should be made of low-friction materials, such as ceramics, highly polished metals and plastics. Thus, the frictional losses across the nozzle-Venturi are minimized. The material used in the orifice valve that was tested was made of 17-ph stainless.

Figure 7A:
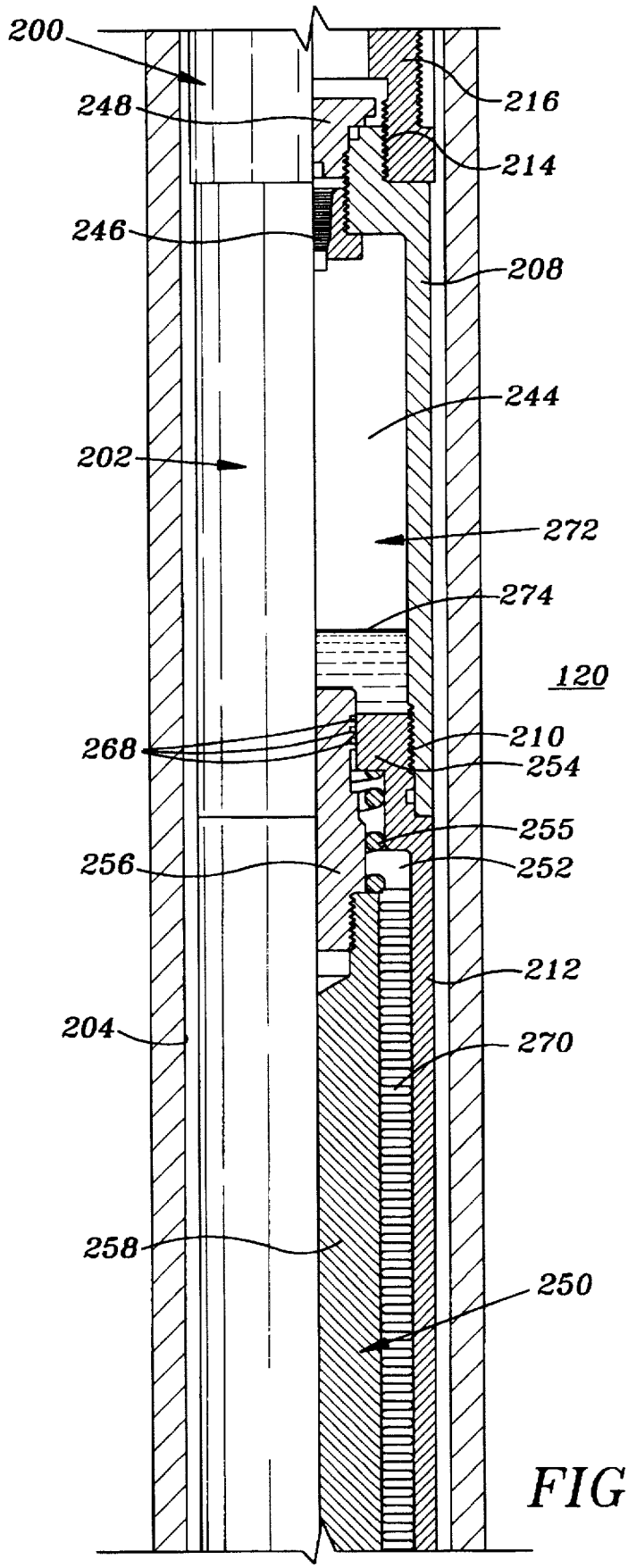
FIG. 7A and 7B illustrate a cross-sectional view of an exemplary gas lift valve of the present invention including a nozzle-Venturi orifice.
Figure 7B:
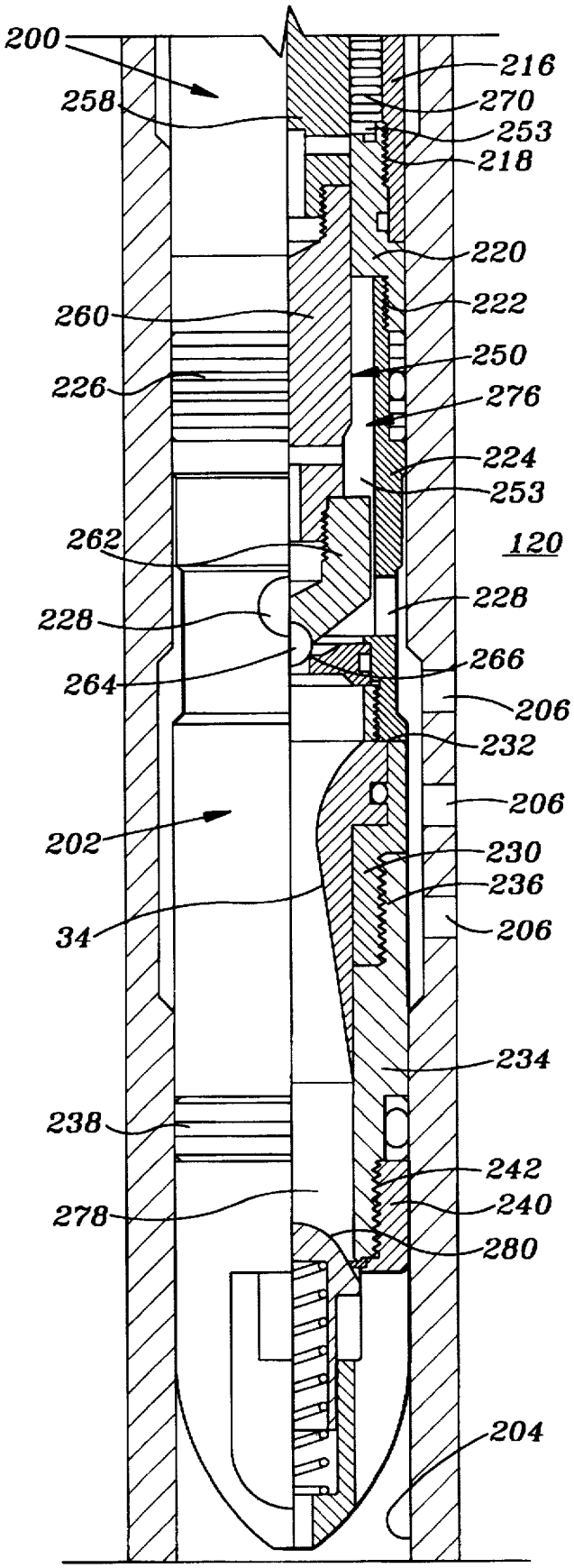

FIGS. 7A and 7B illustrate another preferred embodiment of a gas flow control device of the present invention, where a nozzle-Venturi orifice is housed within an artificial lift valve, also commonly referred to as a gas lift valve. Referring now to FIGS. 7A and 7B, an exemplary artificial lift valve 200 is illustrated in detail, which is representative of artificial lift valves enclosed within a side pocket mandrel included in production tubing. It should be understood that the configuration described for this artificial lift valve is for purposes of explanation only and is not intended to limit the invention to a particular construction of artificial lift valve. Although the construction and general operation of artificial lift valves and their components are well known, this will be described in some detail to provide background and to aid the reader in an understanding of the invention.

As illustrated in FIGS. 7A–7B, in a preferred embodiment of the invention the artificial lift valve 200 is made up of a valve housing, indicated generally at 202, which is shaped and sized to reside within the bore 204 of a side pocket mandrel in production tubing. It is noted that the bore 204 of the side pocket mandrel includes a number of generally radially outward facing lateral ports 206 which permit fluid communication between the interior of the bore 204 and the wellbore annulus 14 (as shown in FIG. 4). The lower portion of the bore 204 also features one or more radially inward-facing apertures (not shown) which will permit fluid communication between the interior of the bore 204 and the flowbore within the tubing string 12 (as shown in FIG. 4). Side pocket mandrel designs of this nature are widely known.

The valve housing 202 itself includes an upper dome sub 208 which is threadedly connected at 210 to a bellows housing 212 below. The upper end of the upper dome sub 208 features a threaded portion 214 which permits the valve housing 202 to be engaged with a latchable member 216 (latchable portion not shown) for secure fastening of the valve 200 within the bore 204 of the side pocket mandrel. The bellows housing 212 is threadedly engaged at 218 at its lower end to a connector sub 220 which, in turn, is threadedly attached to a main valve housing 224. The main valve housing 224 carries an outer annular elastomeric packing 226 which, when the valve 200 is disposed within the bore 204, effects a fluid seal against the inner surface of the bore 204. The main valve housing 224 also presents one or more lateral ports 228 which permit fluid transmission through the main valve housing 224. A valve seat retainer 230 is affixed by threaded connection 232 to the lower end of the main valve housing 224. A nozzle-Venturi housing 234 is threaded at 236 to the valve seat retainer 230 and carries an outer annular packing 238 about its circumference which, when the valve 200 is disposed within the bore 204, effects a fluid seal against the inner surface of the bore 204. Finally, a tapered nose piece 240 is threaded at 242 to the nozzle-Venturi housing 234.

A nitrogen charged chamber or "dome" chamber 244 is located near the top of the valve 200. A fill valve 246 and a removable threaded main seal plug 248 are located thereabove.

Below the dome chamber 244, a main valve assembly 250 is reciprocally disposed within a bellows chamber 252 and a main valve chamber 253 which is defined by the main valve housing 224. A reduced diameter neck 254 is located at the upper portion of the bellows chamber 252 and separates the bellows chamber 252 from the dome chamber 244 above. The main valve assembly 250 is made up of upper, central and lower stem sections 256, 258 and 260, respectively, which are threadedly connected to each other in an end-to-end relation as shown. The main valve assembly 250 also features a valve plug 262 with a downwardly presented spherically-shaped closure member, or ball, 264 threadedly engaged to the bottom of the lower stem section 260. Below the valve plug 262, a valve seat 266 is maintained in place within the main valve chamber 253 by the valve seat retainer 230.

The upper stem section 256 of the main valve assembly 250 is disposed through the reduced diameter neck 254. A series of small annular baffles 268 circumferentially surround portions of the upper stem section 256 which are sized and shaped to receive small amounts of viscous fluid and thus, during movement of the main valve assembly 250, serve to dampen vibration.

Within the bellows chamber 252, and generally radially surrounding the central stem section 258, is an accordion-like bellows 270 which will axially extend and retract within the bellows chamber 252. The bellows 270 is made of a flexible, waterproof material. A compression spring 255 is located within the bellows chamber above the main valve assembly 250 to limit excessive upward travel of the main valve assembly 250 and overcompression of the bellows 270.

Two mutually opposing fluid pressure conducting passages, separated by the bellows 270, are used to control the opening and closing of the main valve assembly 250 due to the fluid seals created between the bore 204 of the surrounding side pocket mandrel and packings 226 and 238. The first pressure conducting passage, generally at 272, includes the dome chamber 244 and the bellows chamber 252. Pressure within this first pressure conducting passage is maintained radially outside of the bellows 270. The first pressure conducting passage 272 is pressurized prior to disposal of the artificial lift valve 200 into the wellbore. The bellows chamber 252 is filled with a viscous fluid until the fluid covers the reduced diameter neck 254 and reaches a level 274 within the dome chamber 244. The dome chamber 244 is then charged with nitrogen through the fill valve 246 prior to being run into the wellbore so as to provide a fluid spring by removing the plug 248 and forcing nitrogen through the fill valve 246 under pressure.

The second pressure conducting passage 276 includes the main valve chamber 253. Fluid and fluid pressure from the wellbore annulus 320 enters the main valve chamber via ports 228. Fluid entering the main valve chamber 253 is maintained radially within the bellows 270.

Resultant pressure within the second pressure conducting passage 276 acts upon the main valve assembly 250 in counterpoint to that provided by the fluid spring of the first pressure conducting passage 272. When the pressure within the second pressure conducting passage 276 overcomes that provided by the fluid spring, the closure member 264 (ball) will be lifted from the seat 266 to permit flow of fluid entering ports 228 to flow downward past the seat 266 and into and through the nozzle-Venturi orifice 34 defined within the nozzle-Venturi housing 234. The nozzle-Venturi orifice 34 (as shown in detail in FIG. 6C) extends downward to and past a check valve assembly 280 at the lower end of the valve 200. Therefore, fluid entering the nozzle-Venturi orifice 34 downward past the valve seat 266 can move downward through the nozzle-Venturi orifice 34, out of the lower end of the valve 200 and into the lower portion of the bore 204 where it may enter the production tubing string through apertures in the mandrel below.

A nozzle-Venturi orifice 34 is maintained within the nozzle-Venturi housing 234 and aligned so that the gas will pass downward through the nozzle-Venturi orifice 34 and out of the lower end of the valve 200. The arrangement of the nozzle-Venturi is best seen by referring once again to FIG. 6C.

In a typical gas lift valve, the combination of the movable stem and seat defines a pressure-adjustable orifice and, in prior art gas lift valves, the larger the ball and seat size, the more that the tubing pressure affects the opening and closing of the valve. Fluctuating tubing pressures can cause the valve to open and close erratically, causing erratic injection rates that may further aggravate the fluctuating tubing pressures. Additionally, prior art gas lift valves are subject to all of the limitations described above that are related to pressure recovery through the assembly. In comparison, a gas lift valve of the present invention will have improved pressure recovery and an increased gas injection rate due to lower frictional losses across the gas lift valve, thereby increasing the efficiency of the gas lift system. Furthermore, the gas lift valve of the present invention will also be less susceptible to fluctuations in the injection rate. In the gas lift valve of the present invention, a converging-diverging, or nozzle-Venturi, orifice downstream of the ball and seat will result in a constant pressure below the ball and seat and injection of the gas at a constant critical flow rate which is determined by the physical geometry of the valve and orifice. Compared to the prior art gas lift valve, a gas lift valve of the present invention will have a lower differential pressure at which critical flow across the gas lift valve will occur.

Figure 8:
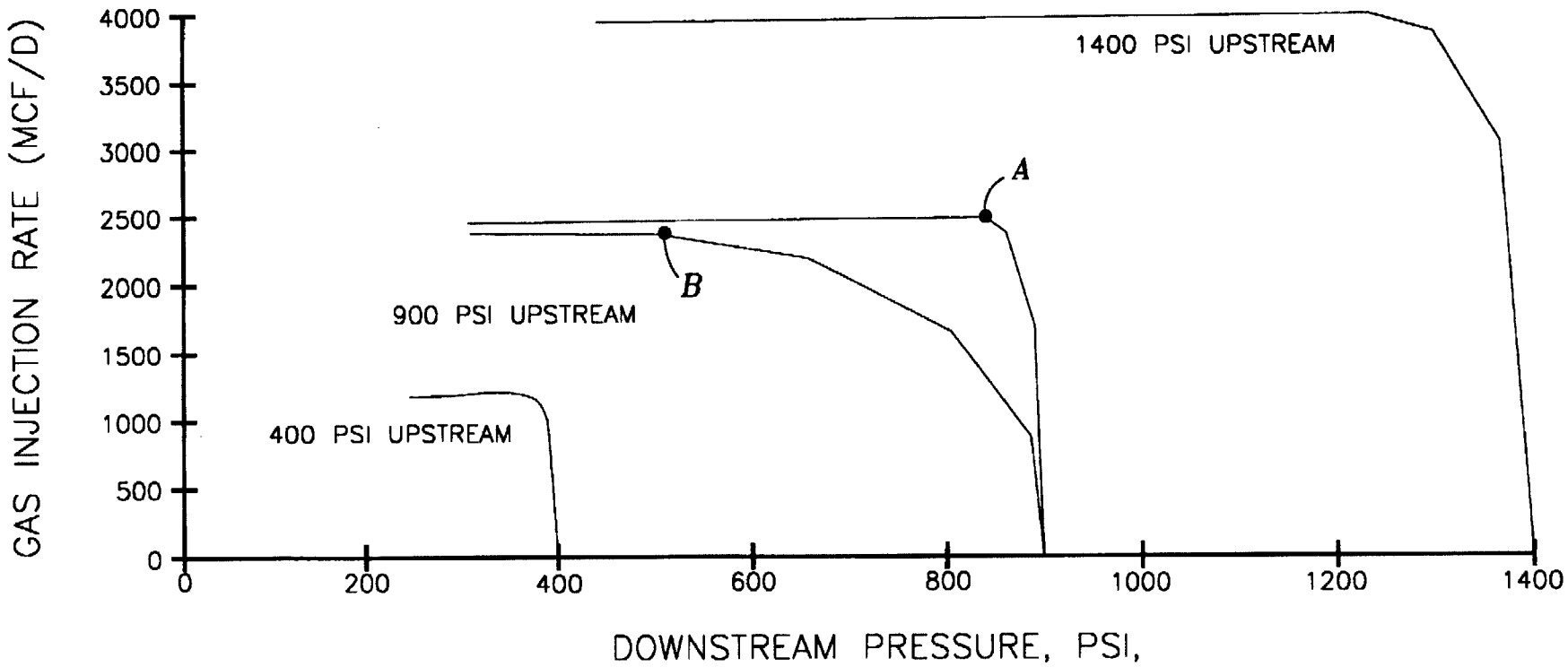
FIG. 8 shows a graph which illustrates the dynamic performance of an exemplary nozzle-Venturi gas flow control device of the present invention at three separate upstream pressures, and also provides a comparison to the dynamic performance of a prior art gas flow control device employing a square-edged orifice, shown in FIG. 2.

FIG. 8 is a graph which illustrates test results showing the dynamic performance of an exemplary nozzle-Venturi orifice gas flow control device of the present invention, as shown in FIGS. 6A and 6B, and the dynamic performance of a conventional gas flow control device having a square-edged orifice, as shown in FIG. 5. A gas flow control device of the present invention, which included a nozzle-Venturi orifice 34 having a throat diameter (item 46 of FIG. 6C) of 0.332 inches, was tested at three separate constant upstream (injection or casing) pressures, namely 400 psi, 900 psi and 1400 psi. Further, test results of the dynamic performance of the injection gas flow control device of the present invention having the present nozzle-Venturi orifice 34 at a constant upstream pressure of 900 psi, which is represented by the curve including point A, is compared to test results of the dynamic performance of a prior art injection gas flow control device, namely a standard orifice valve, having a square-edged orifice 29 (as shown in FIG. 5). The test results for the prior art, square-edged orifice valve are indicated by the curve including point B. Both of the gas flow control devices had the same diameter of 0.322 inches, and both were tested at a constant upstream pressure of 900 psi. The sonic (critical) flow rate regime is that portion of each curve that is horizontal. By operating a gas injection flow control device in the sonic flow regime, a stable gas lift system is achieved. It is readily appreciated that the broad flat portion between the vertical axis and point A, representing stable performance of a gas flow control device of the present invention including a nozzle-Venturi orifice 34, is much wider than the corresponding flat portion between the vertical axis and point B, representing stable performance of a prior art gas control device, namely a conventional orifice valve including a square-edged orifice. Moreover, at similar production pressures, more gas flows through a gas flow control device with a nozzle-Venturi orifice 34 than through a gas flow control device with a square-edged orifice having the same throat size.

Listed below are the test results achieved for various-sized flow control devices of the present invention, namely orifice valves including certain sized nozzle-Venturi orifices, at various upstream (injection) pressures. The results listed are the downstream pressures, in terms of percentages of the upstream pressure, at which critical flow across the flow control devices was reached, which is designated as Point A in FIG. 8. Alternatively, the resulting differential pressure at which critical flow across the flow control devices was reached in the tests is readily calculated as a percentage of the injection pressure by subtracting a given downstream pressure, listed as a percentage of the injection pressure, from 100%.

Downstream Pressure As A Percentage of Injection Pressure At Which Critical Flow Is Reached

| Upstream (Injection) Pressure (PSIG) | | | | | |
|---|---|---|---|---|---|
| 400 | 92.8% | 92.8% | 95.2% | 92.8% | 93.2% |
| 900 | 94.5% | 94.5% | 95.6% | 93.4% | 92.3% |
| 1400 | 94.7% | 94.7% | 95.1% | 90.1% | 92.2% |
| | 0.204 | 0.266 | 0.314 | 0.326 | 0.332 |

Orifice Throat Size In Inches (See Item 46, FIG. 6C)

The gas flow control device of the present invention including the nozzle-Venturi orifice 34 provides for a lower pressure drop in achieving sonic, or critical, flow. Square-edged orifices typically require a pressure drop of 46 percent of upstream pressure to produce sonic velocity flow therethrough. In contrast, as illustrated by the table above, the gas control device of the present invention including a nozzle-Venturi orifice typically requires less than a ten percent pressure drop of upstream pressure, and often less than 6 percent pressure drop of upstream pressure to achieve critical flow. The ability of the gas flow control device to achieve critical flow at such a low pressure drop causes the gas injection rate through the gas flow control device to be generally independent of the tubing pressure, effectively eliminating flow instability as described above. In addition to the gas injection rate being independent of the production tubing pressure, the gas injection rate through the gas flow control device can be controlled by adjusting the injection pressure at the surface; which acts to increase or decrease the pressure and the density of the injected gas in the annulus.

Figure 9:
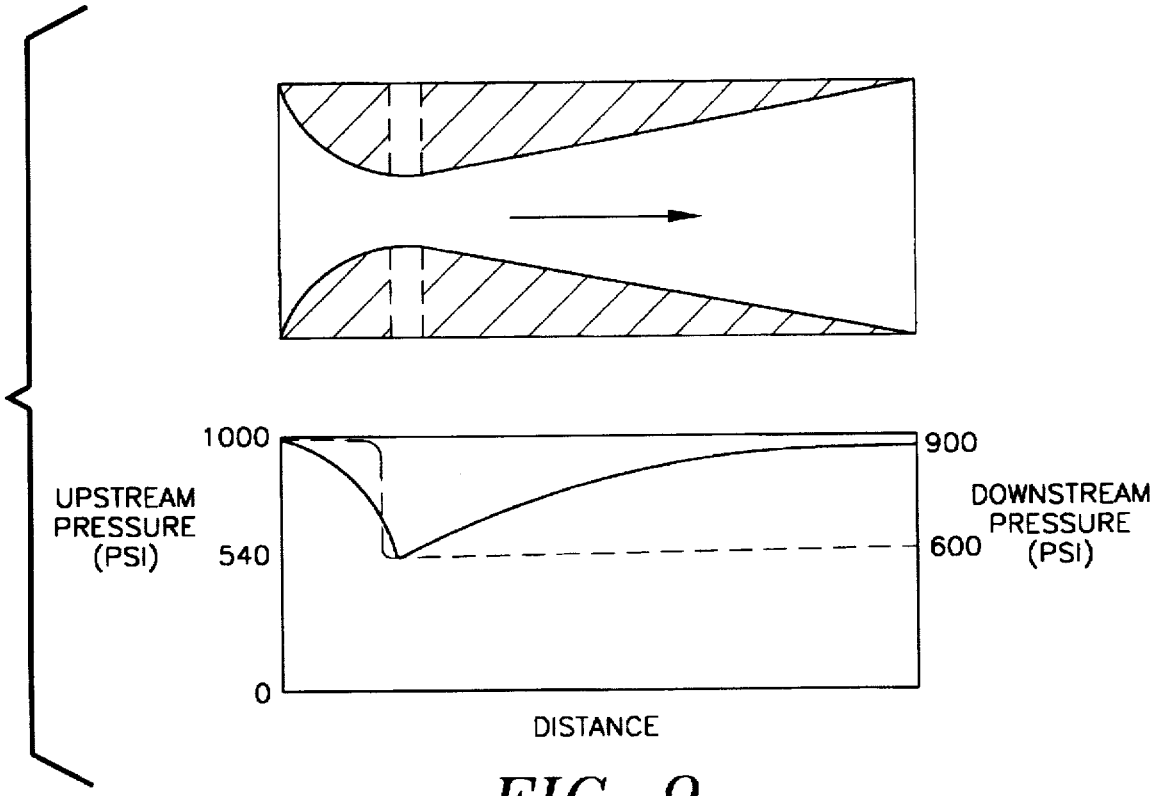
FIG. 9 shows a graph which compares a pressure profile for a square-edged orifice housed in a prior art gas flow control device and a pressure profile for an exemplary nozzle-Venturi orifice housed in a gas flow control device of the present invention.

In order to further explain the difference in the flow performance of a prior art gas flow control device having a square-edged orifice and the flow performance of an exemplary gas flow control device of the present invention having a nozzle-Venturi orifice, FIG. 9 illustrates the pressure profiles of each device. The upper portion of FIG. 9 shows an overlay of the cross-sectional views of the two devices taken along the flow path of the injected gas, with the dotted line representing the a square-edged orifice and the solid line with hatching representing the nozzle-Venturi orifice. The arrow in the upper portion of FIG. 9 indicates the direction of the flow of injected gas through the two devices.

The lower portion of FIG. 9 is a graph that plots the gas pressure within the devices as a function of the position of the gas as it flows through the devices. The dotted line represents the pressure profile for the square-edged orifice of the prior art gas flow control device and the solid line represents the pressure profile of the nozzle-Venturi orifice of the gas flow control device of the present invention. For an injection pressure of 1000 psia, the sonic flow at the throat (the critical flow regime) is established for both devices. For air flow this corresponds to a pressure of approximately 540 psia at the throat. This flow condition results in the maximum mass flow rate as indicated by points A and B in FIG. 8, for the nozzle-Venturi and the square-edged orifice respectively. After the throat, where the greatest velocity and the lowest pressure occurs, the pressure increases (recovers) and the velocity decreases in the direction of the flow. For the nozzle-Venturi a maximum pressure of 900 psia is attained at the exit of the divergent section. The pressure recovery for the square-edged orifice is only slight, resulting in the exit pressure of, for example, 600 psia. Therefore, the sonic flow for a nozzle-Venturi flow control device can be achieved at a much lower pressure differential resulting in a higher exit or production pressure, as compared to a square-edged orifice flow control device.

It therefore can be seen that the present nozzle-Venturi provides for a gas flow control device that minimizes well instabilities by extending the critical flow rate regime, and by rendering lift operations independent of production pressure. The gas flow control device of the present invention thus acts to stabilize the flow of production in the production tubing.

The gas flow control device of the present invention achieves critical flow, that point where any additional pressure drop in the tubing will not result in an increase of flow through the valve, with a pressure drop of approximately 5% of the upstream pressure or greater. Because stable flow through the gas lift valve is established with such a minimum pressure drop, there is no need to have a finite control of the injection gas on the surface.

Although the present invention and its advantages have been described in detail, those skilled in the art should understand that they can make various changes, substitutions and alterations herein without departing from the spirit and scope of the invention in its broadest form.

What is claimed is:

1. A method for achieving critical flow through a downhole flow control valve in a well having a tubing concentrically spaced within a casing by an annulus comprising the steps of:

placing a valve within the well at, a predetermined location;

injecting compressed fluid of density less than a density of reservoir fluids into the annulus;

transmitting the injected fluid from the annulus into a nozzle portion of the valve at a threshold pressure level;

decreasing the pressure of the injected fluid from the threshold level in the nozzle portion of the valve;

increasing the pressure of the injected fluid to a pressure slightly less than the threshold pressure in a Venturi portion of the valve;

mixing fluid ejected from the Venturi portion of the valve with reservoir fluids in the tubing;

varying the pressure of the fluid injected into the annulus to proportionately vary the fluid injection rate through the valve; and stabilizing the pressure of the fluid injected into the annulus at a pressure resulting in critical flow through the valve.

2. A method for achieving critical flow through a downhole flow control valve in a well having a tubing concentrically spaced within a casing by an annulus comprising the steps of:

placing a vane within the well at a predetermined location;

injecting compressed fluid of density less than a density of reservoir fluids into the annulus;

transmitting the injected fluid From the annulus into a nozzle portion of the valve at a threshold pressure level;

decreasing the pressure of the injected fluid from the threshold level in the nozzle portion of the valve;

increasing the pressure of the injected fluid to a pressure slightly less than the threshold pressure in a Venturi portion of the valve;

mixing fluid ejected from the Venturi portion of the valve with reservoir fluids in the tubing;

varying the pressure of the fluid injected into the annulus to proportionately vary the fluid injection rate through the valve; and stabilizing the pressure of the fluid injected into the annulus at a pressure resulting in a constant fluid injection rate independent of the pressure within the tubing.

3. A method for achieving critical flow through a downhole flow control valve in a well having a tubing concentrically spaced within a casing by an annulus comprising the steps of:

placing a valve within the well at a predetermined location;

injecting compressed fluid of density less than a density of reservoir fluids into the annulus;

transmitting the injected fluid from the annulus into a nozzle portion of the valve at a threshold pressure level;

decreasing the pressure of the injected fluid from the threshold level in the nozzle portion of the valve;

increasing the pressure of the injected fluid to a pressure slightly less than the threshold pressure in a Venturi portion of the valve;

mixing fluid ejected from the Venturi portion of the valve with reservoir fluids in the tubing;

varying the pressure of the fluid injected into the annulus to proportionately vary the fluid injection rate through the valve; and stabilizing the pressure of the fluid injected into the annulus at a pressure resulting in critical flow through the valve over a range of tubing pressure extending from about zero to about ninety percent of the casing pressure.

4. In a gas lift system for injecting pressurized gas into a well having a production string, a gas flow control valve comprising:

a housing including at least one inlet port and at least one outlet port;

an orifice comprising a nozzle portion and a Venturi portion;

said nozzle portion including a nozzle first end, a nozzle second end, and a nozzle flow path between said nozzle first end and said nozzle second end; said nozzle flow path converging from said nozzle first end to said nozzle second end, such that the gas experiences a decrease in pressure;

said Venturi portion including a first end and a second end, and a Venturi flow path therebetween, said Venturi flow path diverging from said Venturi first end to said Venturi second end, such that the gas experiences a rise in pressure, said Venturi first end being disposed adjacent said nozzle second end, such that a throat is defined therebetween where critical flow is achieved, said Venturi flow path being aligned with said nozzle flow path to provide a continuous flow path;

whereby said pressurized gas flows into said at least one inlet port of said gas flow control valve through said continuous flow path, and out through said at least one outlet port into said production string; and a check valve means responsive to said flow of pressurized gas.

5. In a gas lift system for injecting pressurized gas into a well having a production string, a gas flow control valve comprising:

a housing including at least one inlet port, and at least one outlet port;

an orifice comprising a nozzle portion and a Venturi portion;

said nozzle portion including a nozzle first end, a nozzle second end, and a nozzle flow path between said nozzle first end and said nozzle second end, said nozzle flow path converging from said nozzle first end to said nozzle second end, such that the gas experiences a decrease in pressure;

said Venturi portion including a first end and a second end, and a Venturi flow path therebetween, said Venturi flow path diverging from said Venturi first end to said Venturi second end, such that the gas experiences a rise in pressure, said Venturi first end being disposed adjacent said nozzle second end, said Venturi flow path being aligned with said nozzle flow path to provide a continuous flow path;

whereby said pressurized gas flows into said at least one inlet port of said gas flow control valve through said continuous flow path, and out through said at least one outlet port into said production string wherein a differential pressure between said nozzle first end and said Venturi second end is less than about 10%; and a check valve means responsive to said flow of pressurized gas.

* * * * *